United States Patent [19]

deFasselle et al.

[11] Patent Number: 4,500,759

[45] Date of Patent: Feb. 19, 1985

[54] FLUID FLOW SWITCH

[76] Inventors: Craig R. deFasselle, 38411 Wood Rd., Willoughby, Ohio 44094; Robert J. deFasselle, Timberidge Trail, Gates Mills, Ohio 44040

[21] Appl. No.: 536,694

[22] Filed: Sep. 28, 1983

[51] Int. Cl.[3] ..... H01H 35/40

[52] U.S. Cl. ..... 200/81.9 R; 200/81.9 M; 200/82 E; 200/308

[58] Field of Search ..... 200/81.9 M, 81.9 R, 200/82 E, 308, 61.86; 92/109; 137/557

[56] References Cited

U.S. PATENT DOCUMENTS

| | | | |
|---|---|---|---|
| 3,446,986 | 5/1969 | Cox | 200/82 E X |
| 4,081,635 | 3/1978 | Moore | 200/82 E X |
| 4,168,413 | 9/1979 | Halpine | 200/82 E |

*Primary Examiner*—A. D. Pellinen
*Assistant Examiner*—Susan Steward
*Attorney, Agent, or Firm*—Frijouf, Rust & Pyle, P.A.

[57] ABSTRACT

A flow switch is disclosed comprising a body member having a fluid inlet and a fluid outlet defined therein. An outer core tube is disposed within the body member and has a first and a second end. An inner core tube is disposed coaxial to and within the outer core tube and has a first and a second end with the first ends of the inner and outer core tubes being disposed adjacent the fluid inlet. One of the inner and outer core tubes being in fluid communication with the fluid inlet. The body member defines a body flow path between the outer core tube and the body member and in fluid communication with the fluid outlet. A first aperture is defined by the inner core tube and a second aperture is defined by the outer core tube. Securing means secures one of the core tubes to be non-rotatable relative to the body member. The other of the core tubes is rotatable relative to the body member enabling the first aperture to register with the second aperture for defining a first orifice of variable size to provide a variable flow path from the fluid inlet to the body flow path and to the fluid outlet in accordance with the relative rotational position between the inner and outer core tubes. A cylindrical chamber is defined by the rotatable core tube. A piston is slidably disposed in the cylindrical chamber for movement in accordance with the fluid flow through the fluid inlet. A switch is disposed proximate the piston for providing a switching output in response to the fluid flow through the fluid inlet exceeding a preselected level.

17 Claims, 12 Drawing Figures

FLUID FLOW SWITCH

BACKGROUND OF THE INVENTION

1. Field of the Invention

This invention relates to a flow switch responsive to a preselected flow rate of a fluid. More particularly, this invention relates to a combined positive displacement and variable area flow path flow switch or the like.

2. Information Disclosure Statement

Various flow switches have been developed to be responsive to the flow rate of a fluid within a flow line. Usually the flow switch is connected into the flow line so that the flow path of the fluid passes through the flow switch. With the in-line type of flow switch, a movable obstacle is disposed within the flow path so that as the rate of flow increases, the movement of the obstacle is responsive to the increase in the flow rate of the fluid. One type of flow switch includes a rotatable vane or sail disposed with the axis of the vane perpendicular to the flow path. The vane partially obstructs the flow of fluid so that as the flow rate increases, a switch is activated upon the flow rate obtaining some desired level.

Many processes require the accurate determination of the rate of flow of a fluid relative to a desired flow rate. Consequently, flow switches have been developed to indicate when the rate of flow in a pipe is above or below some desired rate of fluid flow. By this means, for example, the rate of flow within an oil line can be monitored by a flow switch.

However, it will be evident to those skilled in the art that in order to maintain a flow switch which is sensitive to a small fluctuation in flow rate, a large number of flow switches must be manufactured, each having a specific operating range, in order to meet requirements for a specific process requiring the metering of fluid flow at a specific rate.

The present invention provides a flow switch incorporating an electrical switching device and a combined positive displacement and variable area flow path. The variable area flow path of the present invention is provided so that the flow switch can be roughly set to permit a flow of fluid to the core tube such that a positive displacement piston can operate within a specific operating range which is preset during the manufacture of the flow switch. The variable area flow path of the present invention provides a partial bypass flow path which can be adjusted so that the flow of fluid not being bypassed falls within the range of the sensitivity of the positive displacement piston sliding within the core tube to expose the ports defined by the core tube. The provision of the variable area flow path avoids the necessity of manufacturing a wide range of flow switches to cover the specific requirements of various flow rates.

It is known to provide a flow switch having a magnetic piston with a spring biased against the direction of flow. One particular flow switch of this type includes a bypass orifice which can be positioned through the use of tools. However, this type of flow switch suffers from the problem of a high pressure drop, particularly due to the resistance to flow caused by the spring biased piston. Additionally, this magnetic piston-type flow switch includes a spring which is disposed in the fluid line. This presents a serious limiting factor when metering corrosive liquids. Furthermore, the use of spring biasing means introduces various problems due to the change in compression factors of the spring over a prolonged period which results in inadequate switching of the flow switch.

Therefore it is the primary object of this invention to provide a flow switch which overcomes the aforementioned inadequacies of the prior art and provides an improvement which significantly contributes to the ease with which the rate of flow of a fluid can be detected.

Another object of this invention is the provision of a flow switch having a variable area bypass flow path which is readily adjustable.

Another object of this invention is the provision of an inner and an outer core tube, each tube defining an aperture such that the apertures register with each other to define a variable area orifice therebetween.

Another object of this invention is the provision of an inner and an outer core tube, the core tubes being coaxial and with one of the core tubes being rotatable relative to the other of the core tubes to provide a varable area orifice defined by the apertures of the inner and the outer core tubes.

Another object of this invention is the provision of a top plug which is rotatably disposed relative to the body of the flow switch. The top plug being rigidly connected to the rotatable core tube such that rotation of the top plug relative to the body causes a variation of the area of the orifice.

Another object of the present invention is the provision of a scale indicia and indicator means disposed on the top plug and the flow switch body for inndicating the rotational position of the inner and the outer core tubes.

Another object of the present invention is the provision of a stud which protrudes inwardly from the body adjacent the inlet, the stud cooperating with an open-ended slot defined by the first end of the non-rotatable core tube to inhibit rotation thereof relative to the body.

Another object of the present invention is the provision of a cylindrical chamber defined by the second ends of the rotatable core tube. The chamber housing a composite piston which slides axially along the chamber in response to the increased rate of flow of fluid within the core tubes to progressively expose a larger area of a port defined by the second end of the rotatable core tube.

Another object of the present invention is the provision of a piston comprising a rod received thereto and a recess in the plug for slidably receiving the piston rod.

Another object of the present invention is the provision of a magnetic rod in combination with a magnetic switch for activating the magnetic switch upon movement of the magnetic rod and the piston due to the flow rate of the fluid through the fluid inlet.

Another object of this invention is the provision of a flow switch in which the outer core tube is integrally connected to the inlet and the inner core tube is rotatably disposed coaxially within the outer core tube.

Another object of this invention is the provision of a flow switch including an inductor means and a ferro magnetic rod connected to the first piston for activating the inductor.

Another object of this invention is the provision of a flow switch including a photoelectric sensor disposed adjacent the piston and a light emitting source for emitting a beam of light which is sensed by the sensor, the beam being interrupted by movement of the piston along the cylindrical chamber.

Another object of this invention is the provision of a flow switch in which the top plug includes a plurality of heat exchanger fins.

Another object of this invention is the provision of a flow switch including an observation window disposed within the plug, the window being disposed to permit observation of the movement of the piston within the chamber.

The foregoing has outlined some of the more pertinent objects of the invention. These objects should be construed to be merely illustrative of some of the more prominent features and applications of the present invention. Many other beneficial results can be attained by applying the disclosed invention in a different manner or modifying the invention within the scope of the disclosure. Particularly with regard of the use of the invention disclosed herein, this should not be construed as limited to any particular switching mechanism, but should include flow switches having a variable area bypass flow path and a positive displacement piston. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The flow switch of the present invention is defined by the appended claims with a specific embodiment shown in the attached drawings. For the purpose of summarizing the invention, the invention relates to a flow switch comprising a body member having a fluid inlet and a fluid outlet defined therein. An outer core tube having a first and a second end is disposed within the body member. An inner core tube having a first and a second end is disposed coaxial to and within the outer core tube with the first ends of the inner and outer core tubes being disposed adjacent the fluid inlet. At least one of the inner and outer core tubes is in fluid communication with the fluid inlet. The body member defines a body flow path between the outer core tube and the body member in fluid communication with the fluid outlet. A first aperture is defined by the inner core tube and a second aperture is defined by the outer core tube. Securing means secures one of the core tubes to be non-rotatable relative to the body member. The other of the core tubes is rotatably mounted relative to the body member enabling the first aperture to register with the second aperture for defining a first orifice of variable size to provide a variable flow path to the body flow path and to the fluid outlet in accordance with the relative rotational position between the inner and outer core tubes. A cylindrical chamber is defined by the rotatable core tube. A piston is slidably disposed within the cylindrical chamber for movement in accordance with the fluid flow through the fluid inlet. Switch means is disposed proximate the piston for providing a switching output in response to the fluid flow through the fluid inlet exceeding a preselected level.

In a more specific embodiment of the invention, the flow switch includes a plug rotatably connected to the second end of the rotatable core tube for rotating the rotatable core tube upon rotation of the plug relative to the body member. A fluid sealing means is disposed between the plug and the body member for sealing the cylindrical chamber. Scale indicia and indicator means may optionally be disposed on the plug and on the body member for indicating the rotational position between the inner and outer core tubes. Preferably, the rotatable core tube defines a port disposed adjacent the second end thereof for providing a fluid bypass to the body flow path from the cylindrical chamber. A third aperture may optionally be defined in the outer core tube with the third aperture being diametrically opposed to the second aperture and a fourth aperture may be defined in the inner core tube with the foruth aperture disposed diametrically opposed to the first aperture wherein the third and fourth apertures will register upon registration of the first and second apertures.

The means for securing the non-rotatable core tube may include a slot defined in the non-rotatable core tube for cooperation with a stud extending from the body member to prevent rotation of the non-rotatable core tube relative to the body member. The cylindrical chamber is preferably disposed within the second end of the rotatable core tube and defines a port which cooperates with the piston to define a first opening of variable flow area to the body flow path in accordance with the longitudinal position of the piston within the cylindrical chamber.

The piston preferably includes a piston rod secured to the piston with a plug defining a recess for receiving the piston rod. In one embodiment, the rod is a magnetic rod and the switch means includes a magnetically actuated switch disposed adjacent the magnetic rod for activating the magnetic switch by the magnetic rod upon movement of the rod and the piston due to increased flow of fluid through the fluid inlet. In another embodiment of the invention, the switch means includes a linear variable differential transformer cooperating with the ferro magnetic rod. In still another embodiment of the invention, the switch means includes a photoelectric sensor and light source with the piston rod established for interrupting the light beam to the photoelectric sensor upon movement of the piston beyond a preselected distance. In still a further embodiment of the invention, the plug includes a plurality of heat exchanger fins to prevent overheating the switch means when the fluid is raised to an elevated temperature. A transparent plug or observation window may be disposed within the plug to permit observation of movement of the piston rod or piston within the plug.

The foregoing has outlined rather broadly the more pertinent and important features of the present invention in order that the detailed description of the invention that follows may be better understood so that the present contribution of the art can be more fully appreciated. Additional features of the invention will be described hereinafter which form the subject of the claims of the invention. It should be appreciated by those skilled in the art that the conception and specific embodiments disclosed may be readily utilized as a basis for modifying or designing other devices for carrying out the same purposes of the present invention. It should also be realized by those skilled in the art that such equivalent constructions do not depart from the spirit and scope of the invention set forth in the appended claims.

BRIEF DESCRIPTION OF THE DRAWINGS

For a fuller understanding of the nature and scope of the present invention, reference should had to the following detailed description taken in conjunction with the accompanying drawings in which.

Similar reference characters refer to similar parts throughout the several views of the drawings.

DETAILED DESCRIPTION

Figure 1:
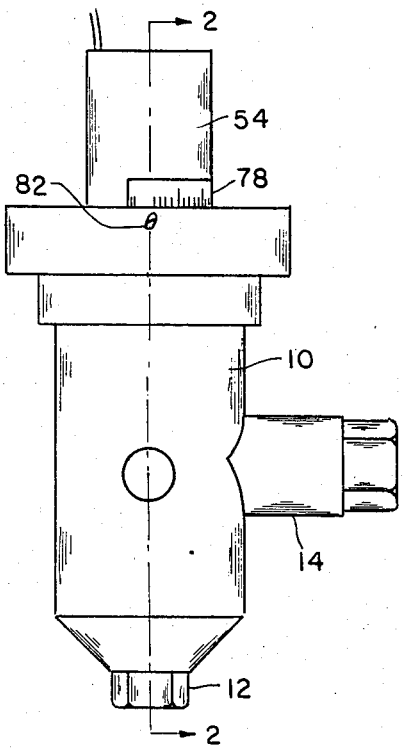
FIG. 1 is an elevational view of a flow switch according to the present invention.
Figure 2:
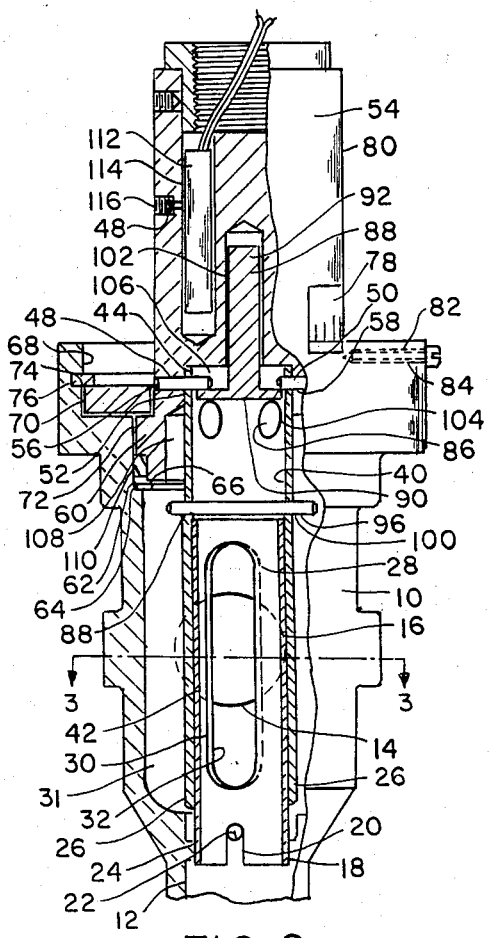
FIG. 2 is a partial cross-sectional view taken on the line 2—2 of FIG. 1.

FIG. 1 is an elevational view of the flow switch according to the present invention. The flow switch includes a body member 10 having a fluid inlet 12 and a fluid outlet 14. As shown in FIG. 2, an inner core tube 16 extends longitudinally within the body member 10 coaxial therewith. A first end 18 of the inner tube 16 is disposed adjacent the inlet 12. Securing means shown as an open ended slot 20 is defined by the first end 18 of the inner core tube 16 and the slot 20 cooperates with an inwardly protruding stud 22 which extends from the body member 10 adjacent the inlet 12. The open ended slot 20 cooperates with the stud 22 to prevent rotation of a non-rotatable or inner core tube 16 relative to the body member 10. The first end 18 of the inner core tube 16 extends through and forms an interference fit with an annular rim 24 which extends radially inwardly around the first end 18 of the inner core tube 16.

Figure 4:
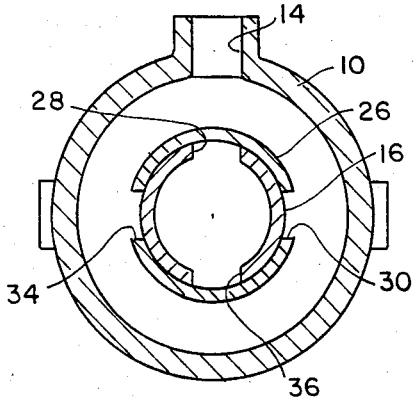
FIG. 4 is a similar view to that shown in FIG. 3, but shows the inner and the outer core tubes rotated to close the orifices.
Figure 3:
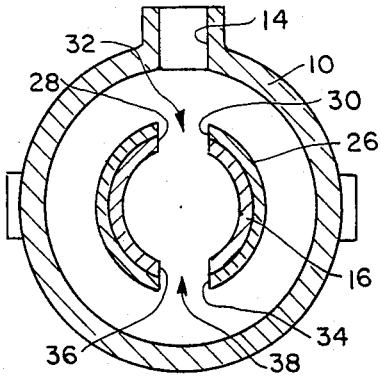
FIG. 3 is a cross-sectional view taken on the line 3—3 of FIG. 2.

An outer core tube 26 coaxial with the inner core tube 16 slides over the inner core tube 16 such that the outer core tube 26 is rotatably supported relative the inner core tube 16 about the longitudinal axis of the inner core tube 16 and the outer core tube 26. The inner core tube 16 defines a first aperture 28 as shown in FIGS. 3 and 4, which extends from adjacent the first end 18 of the inner core tube 16 along a portion of the length of the inner core tube 16. The outer core tube 26, which is a sleeve relative to the inner core tube 16, defines a second aperture 30 such that the first and the second apertures 28 and 30 register with each other to define therebetween a first orifice 32. A body flow path 31 is defined between the outer core tube 26 and the body member 10 in fluid communication with the fluid outlet. Rotation of the outer core tube 26 relative the inner core tube 16 causes a variation in the area of the first orifice 32 and consequently, the area of the bypass flow path which extends from the inlet 12 internally along the inner core tube 16 and through the first orifice 32 and body flow path 31 towards the outlet 14.

In a preferred embodiment of the present invention, a third aperture 34 is defined by the outer core tube diametrically opposite the second aperture 30. Similarly, a fourth aperture 36 is defined by the inner core tube 16 diametrically opposite the first aperture 28. The width of the apertures 28, 30, 34 and 36 is dimensioned such that when the slots are in alignment with each other as shown in FIG. 3, a first portion of the flow path of the fluid within the body 10 passes from the inlet 12 through the inner core tube 16 and through the orifice 32 defined by the aligned slots 28 and 30 and through the outlet 14. Additionally, a second portion of the flow path passes from the inlet 12 through the inner core tube 16 and through a second orifice 38 defined by the aligned slots 34 and 36. A third portion of the flow path passes from the inlet 12 through the inner core tube 16 and into a cylindrical chamber to be described hereinafter. With the slots 28, 30, 34 and 36 aligned as shown in FIG. 3, most of the fluid flowing through the inlet 12 passes through the first and the second portions of the flow path and through the outlet 14. Therefore, most of the fluid passing through the inlet 12 passes through the bypass orifices 32 and 38 and subsequently through body flow path 31 to the outlet 14. A third portion of the fluid flow then flows to the positive displacement piston to be described hereinafter.

However, when the outer core tube 26 is rotated 90 degrees relative the inner core tube 16 as shown in FIG. 4, the orifices 32 and 38 respectively are reduced to zero. In this disposition of the inner and the outer core tubes 16 and 26 respectively, fluid from the inlet 12 flows internally through the inner core tube 16 and enters a cylindrical chamber 40 which is defined by a second end 42 of the inner core tube 16 and a second end 44 of the outer core tube 26. The outer core tube 26 extends from a first end 46 thereof which is disposed adjacent the first end 18 of the inner core tube 16 along the length of the inner core tube 16 and extends past the second end 42 of the inner core tube 16 to the second end 44 of the outer core tube 26. The second end 44 of the outer core tube 26 is locked by pins 48 and 50 within a first bore 52 defined by a top plug 54. The pin 48 cooperates in a press fit into a second bore 56 defined by the top plug 54. The pin 50 cooperates in a press fit into a third bore 58 defined by the top plug 54 and spaced diametrically opposite the second bore 56. The pins 48 and 50 are sealed with plug 54 by conventional means such as welding, brazing or cementing. The pins 48 and 50 lock the second end 44 of the outer core tube 26 within the top plug 54 such that rotational movement of the top plug 54 about the longitudinal axis of the core tubes 16 and 26 results in rotation of the rotatable outer core tube 26 relative to the non-rotatable inner core tube 16 which is prevented from rotation by the stud 22 and cooperating slot 20.

The top plug 54 defines an annular ridge 60 which cooperates with an O-ring seal 62. A first counterbore 64 defined by the body member 10 houses a restraining ring 66 which cooperates with the O-ring seal 62 to position the plug 54 on the body member 10. A second counterbore 68 defined by the body member 10 houses a locking ring 70 which cooperates with a shoulder 72 of the annular ridge 60. A spring retaining ring 74 cooperates with an annular groove 76 defined by the internal surface of the body member 10 to retain the locking ring 70 within the second counterbore 68 of the body member 10.

A scale indicia 78 is disposed on the cylindrical outer surface 80 of the top plug 54 and includes an indicator pin 82 threadably engaging a bore 84 defined by the body member 10. The indicator pin 82 cooperates with the scale indicia 78 to indicate the relative rotation between the top plug 54 and the body member 10. Because the outer core tube 26 is rigidly connected by pins 48 and 50 to the top plug 54, rotation of the top plug 54 causes the outer core tube 26 to rotate relative the body member 10 and the inner core tube 16. The scale indicia 78 is calibrated to indicate the relative position of the first and the second orifice 32 and 38 between a closed position as shown in FIG. 4 and an open position as shown in FIG. 3. It should be appreciated that the indicator and indicia may be interchanged.

The cylindrical chamber 40 houses a piston 86 which is slidable axially within the chamber 40. The piston 86 is secured to a piston rod 88 having a first end 90 and a second end 92. A locating pin 96 traverses through the rotatable core tube 26 and extends through diametrically opposite holes 98 and 100 defined by the outer or rotatable core tube 26. The locating pin 96 cooperates with the piston 86 to limit the downward stroke of the piston 86 within the chamber 40. The second end 92 of the rod 88 is slidably received within a recess or fourth bore 102 defined by the top plug 54. The fourth bore 102 is coaxial with the first bore 52 of the top plug 54.

When the third portion of the fluid flow that is not bypassed through orifices 32 and 38 flows through the inner core tube 16 and enters the chamber 40, the piston 86 slides axially within the chamber 40. As the pistons 86 slides within chamber 40, a plurality of ports 104 and 106 are progressively uncovered by the piston 86. An increase in the rate of flow of fluid through chamber 40 causes the pistons 94 and 86 to progressively uncover an increased area of the ports 104 and 106. Fluid flowing through the ports 104 and 106 enters an annular cavity 108 defined by a fifth bore 110 of the top plug 54. Fluid flowing through the ports 104 and 106 and through the cavity 108 recombines with the first and second portion of the bypass fluid flowing through the orifices 32 and 38 and the recombined first, second and third flow paths exit the body flow path 31 by fluid outlet 14.

As the piston 86 slides within the chamber 40 due to the flow of fluid through the chamber 40 and through the ports 104 and 106, the second end 92 of the rod 88 slides axially within the fourth bore 102. In this embodiment, rod 88 is shown as a magnetic rod for cooperation with a magnetic switch 112. The magnetically actuated switch 112 is disposed within a sixth bore 114 of the top plug 54 with the sixth bore 114 being disposed adjacent the fourth bore 102 such that movement of the magnetic rod 88 within the fourth bore 102 causes activation of the magnetic switch 112. The switch 112 is electrically connected to a device (not shown) for indicating that the flow of fluid through the fluid inlet 12 has increased or decreased beyond a predetermined parameter. The switch 112 is adjustably located within the sixth bore 114 by means of a set screw 116 which threadably engages a bore 118 defined by the body 10.

Figure 6:
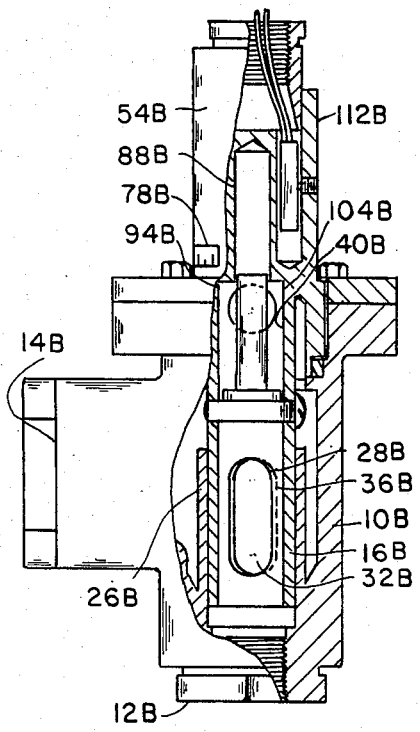
FIG. 6 is a partial cross-sectional view on a reduced scale of a further embodiment of the present invention in which the flow switch is of a transparent plastics material.

In operation, the flow switch is connected into the flow line such that fluid enters the flow body member 10 through the inlet 12. The piston 86 is initially resting on pin 96 as shown in FIG. 6. The top plug 54 is rotatably adjusted from the position shown in FIG. 3 in which most of the fluid flow is bypassed through orifices 32 and 38 to a position such that the piston 86 begins to move along the chamber 40 to the position shown in FIG. 8 prior to the piston 86 exposing the area of the ports 104 and 106. Switch 112 may be adjusted with the sixth bore 114 to be in the activated position. At this adjusted location of the top plug 54 relative the body member 10, the positive displacement piston 86 and the attached rod 88 react with peak sensitivity relative the fluid flow not being bypassed through the orifices 32 and 38. With this peak sensitivity, the flow switch of the present invention accurately detects the rate of flow of fluid within the flow switch because even a slight increase in the rate of fluid flow will cause the piston 86 to be displaced within the chamber 40 resulting in the actuation of the switch 112 as described hereinbefore. If the flow rate continues to increase, piston 86 continues to move upwardly thereby exposing ports 104 and 106. Ports 104 and 106 relieve the fluid pressure after activation of switch 112. Switch 112 remains activated upon further upward movement of piston 86.

When the flow switch is being used to detect a substantially constant high rate of fluid flow, the top plug 54 is rotated to approximately the position shown in FIG. 4 in which the orifices 32 and 38 have the largest area. In this position the majority of the fluid flow is bypassed directly to the outlet 14. Only a small portion of the total fluid flow enters chamber 40 to displace the piston 86. Therefore the rod 88 and cooperating switch 112 accurately detect the flow rate as the rod 88 actuates the switch 112.

When the flow switch is being used to detect a substantially constant low rate of fluid flow, the top plug 54 is rotated to approximately the position shown in FIG. 3 in which the orifices 32 and 38 have an area which is reduced to zero. In this position, the low fluid flow is not bypassed but enters the chamber 40 and displaces the piston 86 and the fluid passes through ports 104 and 106 to the outlet 14. When detecting either a relatively low flow rate or a relatively high flow rate, it will be apparent to those skilled in the art that the present flow switch switch device provides an accurate and sensitive means for detecting flow rates.

When the flow switch of the present invention is used to detect a constant flow rate between the aforementioned high and low flow rates, it will be evident that the top plug 54 can be rotated until a position thereof is located which enables the flow switch to operate with the optimum sensitivity relative to that particular flow rate.

Figure 5:
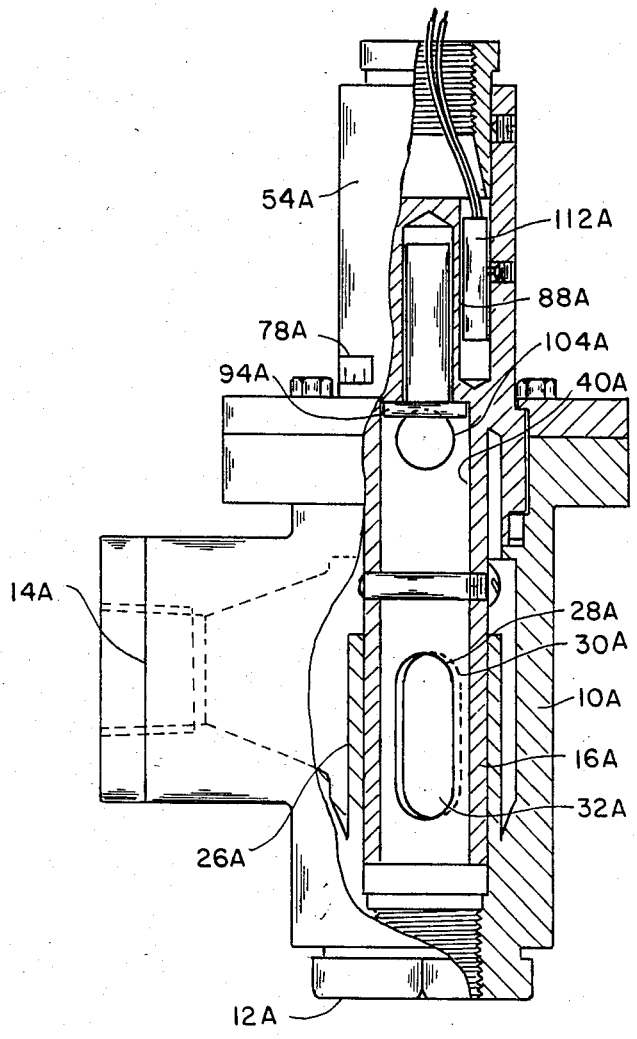
FIG. 5 is a partial cross-sectional view of a further embodiment of the present invention.

In a further embodiment of the present invention as shown in FIG. 5, similar reference characters refer to similar parts relative the first embodiment as shown in FIGS. 1–4. However, in this embodiment the reference characters are suffixed by the letter "A". In the further embodiment as shown in FIG. 5, the outer core tube 26A is integrally connected to the body member 10A adjacent the inlet 12 A. The inner core tube 16A is integrally connected to the top plug 54A. The operation of the further embodiment of the invention as shown in FIG. 5 is similar to that of the embodiment shown in FIGS. 1–4.

In another embodiment of the present invention as shown in FIG. 6, the flow switch can be of a transparent plastics material such as Lexan or UDEL Polysulphone or the like. Lexan and UDEL are registered trademarks. When the flow switch top plug 54B is fabricated from a transparent plastics material, the movement of the piston 94B within the chamber 40B can be readily observed during operation of the flow switch.

Figure 7:
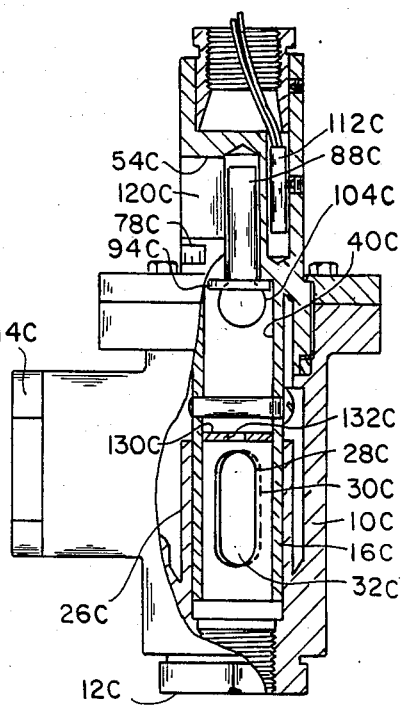
FIG. 7 is a partial cross-sectional view on a reduced scale of a further embodiment of the present invention in which the flow switch includes an observation window.

An alternative embodiment from that shown in FIG. 6 is shown in FIG. 7 in which the flow switch is fabricated from an opaque plastic or metal. However, an observation window 120C is disposed within the top plug 54C adjacent the piston 94C and magnetic rod 88C. The window 120C permits observation of the rod 88C within the top plug 54C.

The embodiment shown in FIG. 7 includes a plate 130C having a restrictive orifice for 132C for reducing the fluid flow into chamber 40C. The use of the plate 130C and restrictive orifice 132C enables the flow switch to be used with higher flow rates. The plate 130C may be permanently secured to the core tube 16C by brazing as shown or may be removably mounted thereon.

Figure 8:
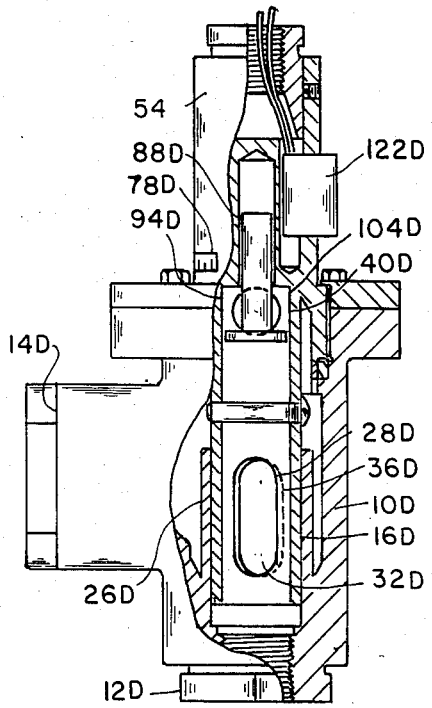
FIG. 8 is a partial cross-sectional view on a reduced scale of a further embodiment of the present invention in which the flow switch includes an inductor sensor.

In a further embodiment of the present invention shown in FIG. 8, an inductor 122D is incorporated in place of the magnetically actuated switch. The inductor 122D is activated by a ferro magnetic rod 88D as should be apparent to those skilled in the art.

Figure 9:
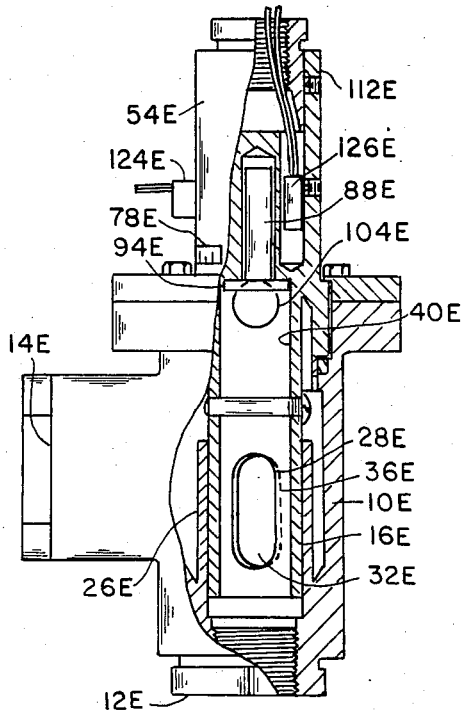
FIG. 9 is a partial cross-sectional view on a reduced scale of a further embodiment of the present invention in which the flow switch includes a light emitting source and a photo-sensitive sensor.

FIG. 9 shows an alternative embodiment of the present invention wherein a light source shown diagramatically as 124E is disposed adjacent the wod 88E. The top plug 54E is fabricated from transparent plastics material as described with reference to FIG. 6. A beam of light from the light source 124E is detected by a photo-sensitive element 126E disposed on the opposite side of the top plug 54E from the light source 124E. The light beam is interrupted by the rod 88E when the rod 88E moves along the chamber 40E. When no light from the light source 124E is detected by the sensor 126E, the sensor 126E activates or deactivates a remote device.

Figure 10:
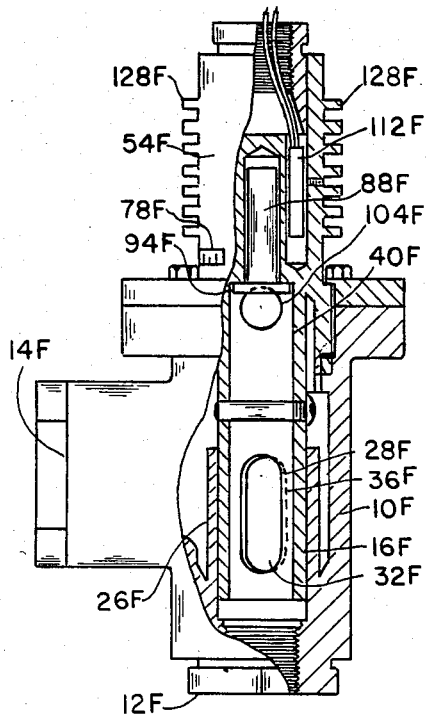
FIG. 10 is a partial corss-sectional view on a reduced scale of a further embodiment of the present invention in which the top plug includes a plurality of heat exchanger fins.

In yet a further embodiment of the present invention as shown in FIG. 10, the top plug 54F is integrally formed with a plurality of heat exchanger fins 128F for dissipating the heat from the magnetically actuated switch 112F when the flow switch is being used to detect the flow of hot fluids.

Figure 11:
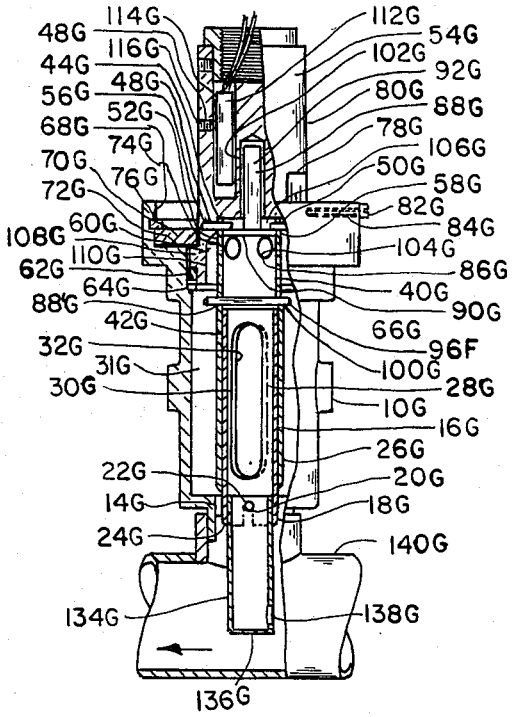
FIG. 11 is a partial cross-sectional view of one embodiment of the invention incorporating a impact tube disposed in a large pipe.

FIG. 11 is a variation of the invention shown in FIGS. 1–10. In this embodiment, the flow switch input is defined by the inner core tube 16G having a terminating plate 136G with an impact aperture 138G disposed in a pipe 140G containing a fluid flow as indicated by the arrow. Fluid entering impact aperture 138G proceeds through the inner core tube 16G to pass through first and second apertures 28G and 32G to enter the body flow path 31G to exit through the fluid outlet 14G. In this embodiment, the use of the impact aperture disposed on the impact tube 134G enables the flow switch to be used with higher flow rates and in large pipes without substantial modification of the flow switch.

Figure 12:
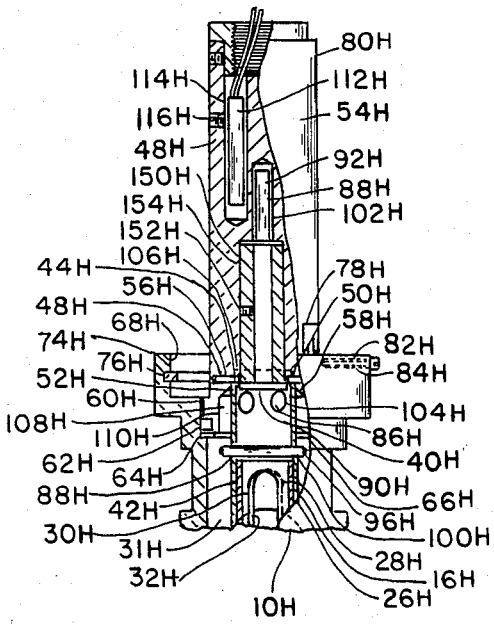
FIG. 12 is a variation of FIG. 2 incorporating variable weight piston means.

FIG. 12 shows a further embodiment of the invention incorporating a cylindrical weight 150H which is secured to rod 92H by a set screw 152H defined in a threaded aperture 154H. The use of the piston weight 150H enables the same flow switch to be used with various flow rates and various density fluids by the convenient interchanging of the weights 150H for various applications. It should be appreciated that the various additional features shown in FIGS. 5–12 may be incorporated within any of the embodiments shown in this disclosure.

The present disclosure includes that contained in the appended claims as well as that of the foregoing description. Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A flow switch, comprising in combination:
- a body member;
- a fluid inlet defined by said body member;
- a fluid outlet defined by said body member;
- an outer core tube disposed within said body member and having a first and a second end;
- an inner core tube disposed coaxial to and within said outer core tube and having a first and a second end;
- said first ends of said inner and outer core tubes being disposed adjacent said fluid inlet;
- at least one of said inner and outer core tubes being in fluid communication with said fluid inlet;
- said body member defining a body flow path between said outer core tube and said body member in communication with said fluid outlet;
- a first aperture defined by said inner core tube;
- a second aperture defined by said outer core tube;
- securing means for securing one of said core tubes to be non-rotatable relative to said body member;
- means for rotatably mounting the other of said core tubes relative to said body member enabling said first aperture to register with said second aperture for defining a first orifice of variable size to provide a variable flow bypass path to said body flow path in accordance with the relative rotational position between said inner and said outer core tubes;
- a cylindrical chamber defined by said rotatable core tube;
- a piston slidably disposed within said cylindrical chamber for movement in accordance with the fluid flow through said fluid inlet; and
- switch means disposed proximate said piston for providing a switching output in response to fluid flow through said fluid inlet exceeding a preselected level.

2. A flow switch as set forth in claim 1, further including:
- a plug rigidly connected to said second end of said rotatable core tube for rotating said rotatable core tube upon rotation of said plug relative to said body member; and
- a fluid sealing means disposed between said plug and said body member for sealing said cylindrical chamber.

3. A flow switch as set forth in claim 2, further including:
- scale indicia and indicator means disposed on said plug and said body member for indicating the rotational position between said inner and outer core tubes.

4. A flow switch as set forth in claim 1, wherein said rotatable core tube defines a port disposed adjacent said second end for providing a fluid bypass to said body flow path from said cylindrical chamber.

5. A flow switch as set forth in claim 1, further including:

a third aperture defined by said outer core tube, said third aperture being disposed diametrically opposite said second aperture; and a fourth aperture defined by said inner core tube, said fourth aperture being disposed diametrically opposite said first aperture.

6. A flow switch as set forth in claim 1 wherein said securing means includes a slot defined by said non-rotatable core tube with said slot being disposed adjacent said first end;

a stud extending from said body member for cooperating with said slot to prevent rotation of said non-rotatable core tube relative said body.

7. A flow switch as set forth in claim 1, wherein said cylindrical chamber is disposed within said second end of said rotatable core tube;

a port defined by said rotatable core tube and being disposed in said cylindrical chamber; and said port cooperating with said piston to define a first opening of variable flow area to said body flow path in accordance with the longitudinal position of said piston within said cylindrical chamber.

8. A flow switch as set forth in claim 1, wherein said second end of said rotatable core tube extends beyond said second end of said non-rotatable core tube;

said cylindrical chamber being defined by said second end of said rotatable core tube extending beyond said second end of said non-rotatable core tube.

9. A flow switch as set forth in claim 1, wherein said piston includes a piston rod secured to said piston; and said plug defining a recess for receiving said piston rod therein.

10. A flow switch as set forth in claim 8, wherein said piston rod includes a magnetic rod; and said switch means includes a magnetically actuated switch disposed adjacent said magnetic rod for activation of said magnetic switch by said magnetic rod upon movement of said rod and said piston due to an increased flow of fluid through said fluid inlet.

11. A flow switch as set forth in claim 8, wherein said first end of said non-rotatable core tube is integrally connected to said body member.

12. A flow switch as set forth in claim 8, wherein said switch means includes inductor means; and a ferro magnetic rod connected to said piston for activating said inductor means.

13. A flow switch as set forth in claim 8, wherein said switch means includes a photoelectric sensor and a light source; and said piston rod established for interrupting the light beam to said photoelectric sensor upon movement of said piston beyond a preselected distance.

14. A flow switch as set forth in claim 2, wherein said plug includes a plurality of heat exchanger fins.

15. A flow switch as set forth in claim 8, further including an observation window disposed within said plug, said window being disposed to permit observation of the movement of said piston within said chamber.

16. A flow switch as set forth in claim 1, including a restrictive orifice disposed in one of said core tubes between said fluid inlet and said cylindrical chamber.

17. A flow switch as set forth in claim 1, including an inpact tube means in fluid communication with said fluid inlet for reducing the fluid flow therethrough.

* * * * *

UNITED STATES PATENT AND TRADEMARK OFFICE

CERTIFICATE OF CORRECTION

PATENT NO. : 4,500,759

DATED : February 19, 1985

INVENTOR(S) : deFasselle

It is certified that error appears in the above-identified patent and that said Letters Patent are hereby corrected as shown below:

Column 4, line 9, delete "foruth" and insert --fourth--.
Column 9, line 31, delete "wod" and insert --rod--.

Signed and Sealed this

*Seventeenth* Day of *September 1985*

[SEAL]

*Attest:*

*Attesting Officer*

DONALD J. QUIGG

*Commissioner of Patents and Trademarks—Designate*